US008246163B2

(12) United States Patent
Ruhe et al.

(10) Patent No.: US 8,246,163 B2
(45) Date of Patent: Aug. 21, 2012

(54) PRINTER SUPPORT SURFACE WITH SUPPORT ROD

(75) Inventors: Thomas W. Ruhe, La Center, WA (US); Geoffrey C. Mayne, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 205 days.

(21) Appl. No.: 12/817,108

(22) Filed: Jun. 16, 2010

(65) Prior Publication Data

US 2011/0310208 A1 Dec. 22, 2011

(51) Int. Cl.

| | |
|---|---|
| ***B41J 29/13*** | (2006.01) |
| ***B41J 23/00*** | (2006.01) |
| ***B41J 2/05*** | (2006.01) |
| ***B41J 5/00*** | (2006.01) |

(52) U.S. Cl. ..... 347/108; 347/37; 347/56; 400/354

(58) Field of Classification Search ..... None
See application file for complete search history.

(56) References Cited

U.S. PATENT DOCUMENTS

| | | | | |
|---|---|---|---|---|
| 4,466,753 | A * | 8/1984 | Willcox | 400/354 |
| 4,990,937 | A | 2/1991 | Tashiro et al. | |
| 6,036,380 | A | 3/2000 | Astroth et al. | |
| 6,161,925 | A | 12/2000 | Reinten | |
| 6,595,633 | B2 * | 7/2003 | McCord et al. | 347/108 |
| 6,789,876 | B2 | 9/2004 | Barclay et al. | |
| 7,075,686 | B2 | 7/2006 | Hayashi | |
| 7,292,807 | B2 | 11/2007 | Nowak et al. | |
| 2007/0177923 | A1 | 8/2007 | Eoka | |
| 2009/0295866 | A1 | 12/2009 | Ray et al. | |

FOREIGN PATENT DOCUMENTS

| | | | |
|---|---|---|---|
| JP | 7017086 | A | 1/1991 |
| JP | 200512271 | A | 9/2004 |

* cited by examiner

*Primary Examiner* — Stephen Meier
*Assistant Examiner* — Alexander C Witkowski

(57) ABSTRACT

A support rod is mounted to maintain straightness of a support surface of a printer. The support rod is used to preload the support surface in a direction opposite of an expected transverse load upon the support surface. The preloading supplied by the support rod counteracts a bending force on the support surface resulting from the expected transverse loading.

20 Claims, 8 Drawing Sheets

PRINTER SUPPORT SURFACE WITH SUPPORT ROD

BACKGROUND

In printers with a moving carriage, the wider the media fed through the printer, the greater the distance traveled by the carriage. Typically, the carriage travels along a carriage rod mounted on a backbone, which is a support surface, typically made from sheet metal. Under the moving carriage, media is supported during printing by a support surface generally referred to as a platen.

When the print width of a moving carriage printer is increased, the stiffness of each widened element is significantly decreased. When the lengthened elements must support a transverse load, significant bending deformation can result. This can adversely affect printing performance.

The backbone and the platen need to support transverse loading, for example when they are required to pinch print media against a rotating drive roller. The total amount of transverse loading to be provided by the backbone and platen depend upon the width of the media. If a printer is designed to handle wider media, the backbone and platen must proportionately provide a greater amount of transverse loading in order to provide a uniform amount of pinch force across the entire width of the media. This linear increase in transverse loading results in an exponential increase in stress tending to bend the backbone and the platen. The bending can result in inconsistent pinch force across the width of the media and may result in a complete loss of pinch force at the center of the media. The bending of the backbone can also result in non-uniformity in the distance between the carriage and the media during printing.

In order to compensate against increased transverse loading, the thickness of the sheet metal can be increased, or stiffer materials can be selected reducing the amount of bending. For example beryllium or tungsten steel alloy can be used instead of standard carbon steel to form the backbone and the platen. Changing the shape of the backbone and the platen can also reduce bending. However, such solutions can adversely affect one or more of the printer size, weight and cost of materials.

DESCRIPTION OF EMBODIMENTS

It is desirable to maintain straightness of support surfaces within a printer, even when the support surfaces are lengthened, for example, in order to allow handling of wider media.

Figure 1:
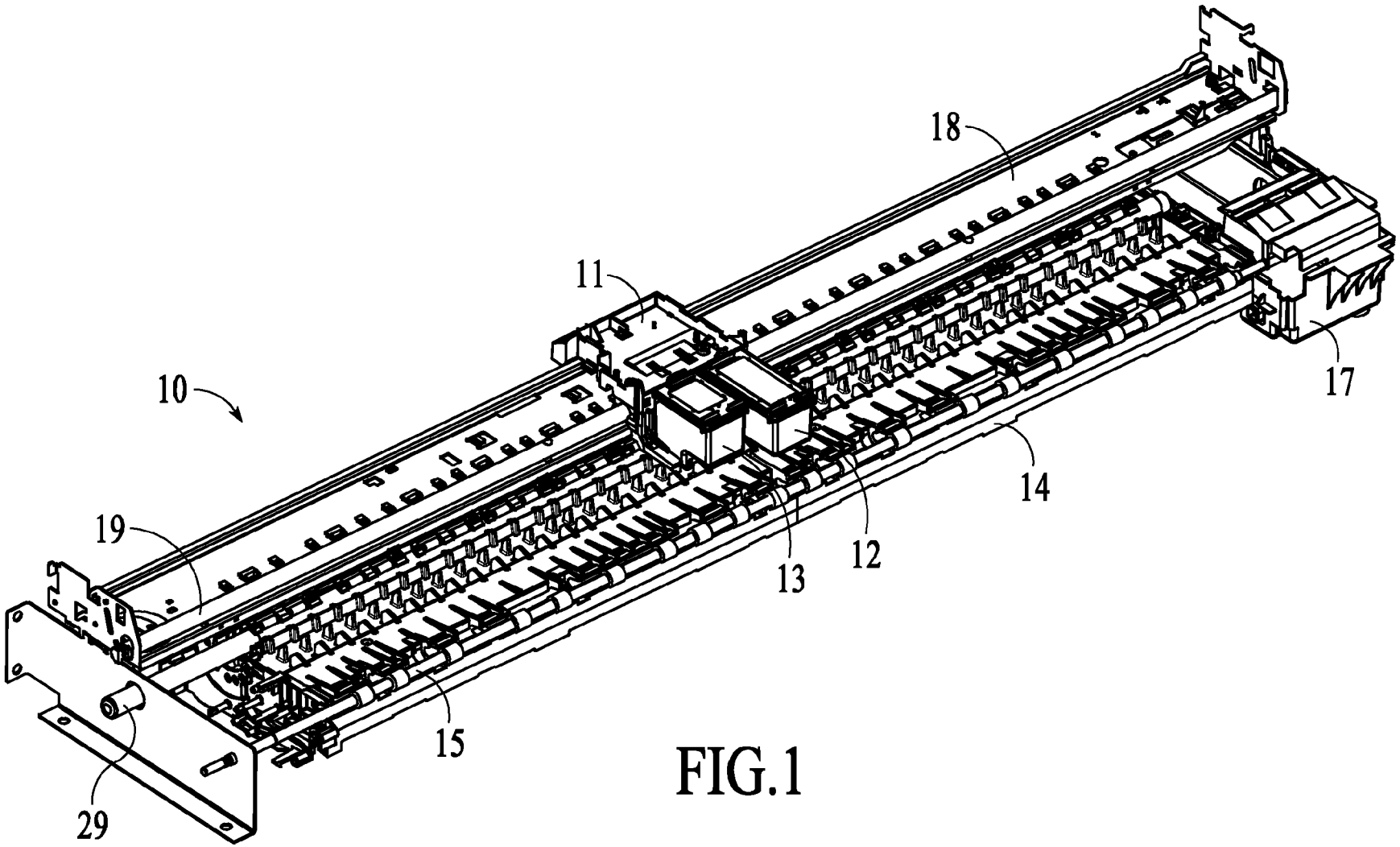
FIG. 1 shows a front view of printer backbone mounted over a printer platen in accordance with an embodiment of the present invention.

FIG. 1 shows a front view of a portion of a printer 10 in which straightness is maintained despite lengthened support surfaces. Printer 10 includes a platen 14, a service station 17 and media rollers 15. A backbone 18 provides support for a carriage rod 19. Platen 14 and backbone 18 are examples of support surfaces that can be lengthened in order to allow for handling of wider media.

A portion of feedshaft 29 is shown although the rest of the printer parts used to provide media input are not shown to aid in explanation of features of the described embodiment of the invention. Media feeds over platen 14 and under backbone 18. As media feeds over platen 14, a carriage 11 holding a pen 12 and a pen 13, travels back and forth across carriage rod 19 to place pen 12 and pen 13 in position for printing.

For example, carriage rod 19 is composed of nickel plated metal. Backbone 18 is formed, for example, from a single sheet of carbon steel.

Figure 2:
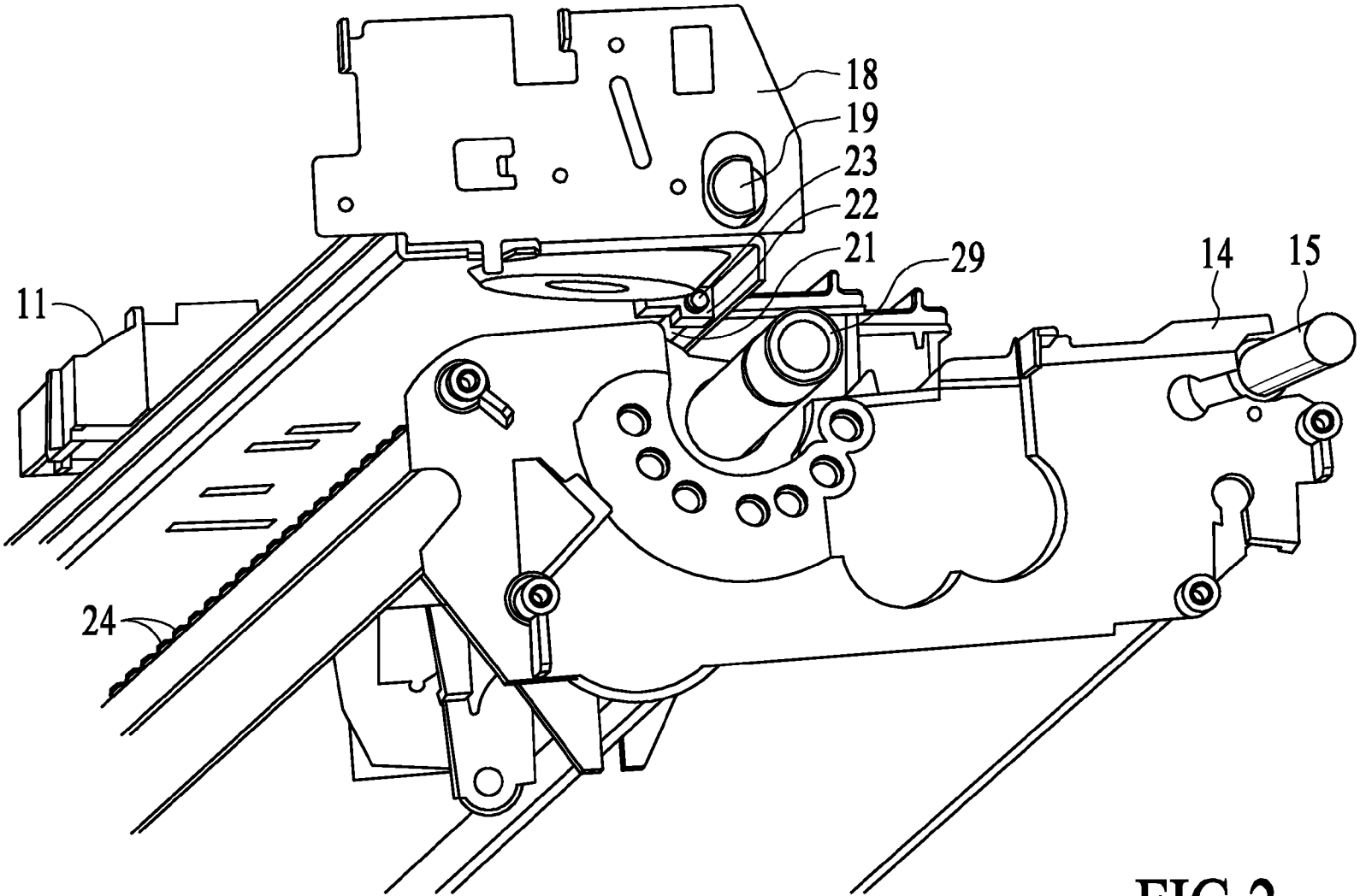
FIG. 2 shows a left rear view of a printer that incorporates the printer backbone and printer platen shown in FIG. 1 in accordance with an embodiment of the present invention.

FIG. 2 is a left rear view of printer 10. Media to be printed upon is fed through a media path 24, under backbone 18 and over platen 14. As seen in FIG. 2, underneath backbone 18 is attached a support rod 21. While FIG. 2 shows support rod 21 located below backbone 18, in alternative embodiments support rod 21 can be located above backbone 18. Support rod 21 is shown attached to backbone 18 by use of rod anchor 22. A threaded pin 23 is used to adjust the tension or compression across support rod 21. Instead of threaded pin 23, another form of adjuster, such as a cam, can be used to change an amount that support rod 21 is tensioned or compressed. Support rod 21 is formed, for example, of steel, graphite or another suitable material.

Support rod 21 is used to preload backbone 18 in a direction opposite of an expected transverse load upon backbone 18. The preloading supplied by support rod 21 counteracts a bending force on backbone 18 resulting from the expected transverse loading. The preloading is accomplished, for example, by connecting support rod 21 to backbone 18 in an orientation so that a bend in support rod 21 preloads backbone 18 in the direction opposite the expected transverse load upon backbone 18. In addition to, or instead of, using a bend in support rod 21 to preload backbone 18, the preloading can be accomplished by an adjuster that changes an amount support rod 21 is compressed or tensioned between rod anchor 22 and a rod anchor 33 shown in FIG. 4. An example of such an adjuster is threaded pin 23. Alternatively, a cam or other adjusting device can be used.

Figure 3:
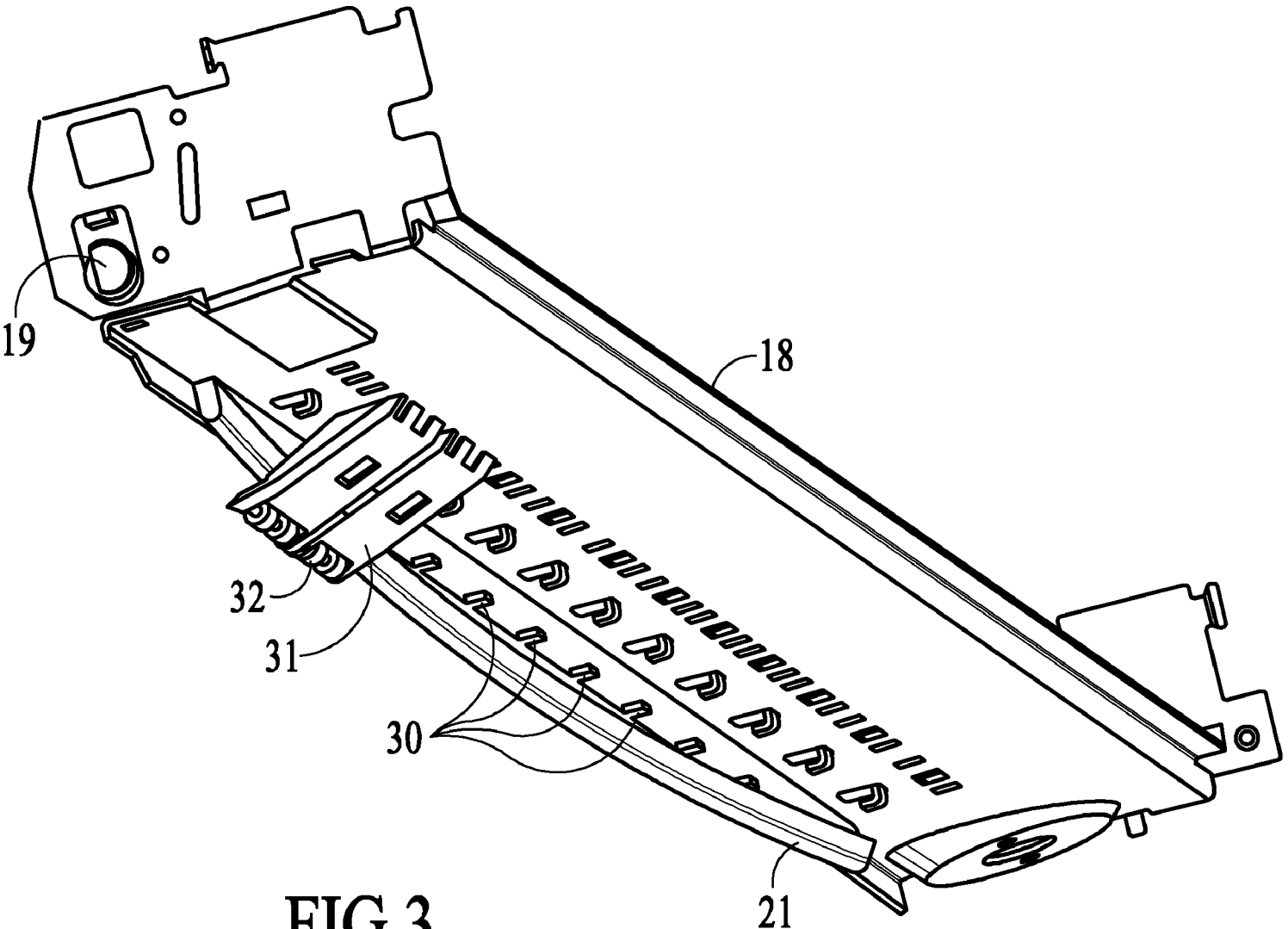
FIG. 3 is a right rear view of a portion of the backbone shown in FIG. 1, illustrating connection of a support rod to the backbone in accordance with an embodiment of the present invention.

FIG. 3 is a right rear view of a portion of backbone 18. Rod support hooks 30 are used to additionally secure support rod 21 to backbone 18. In FIG. 3, support rod 21 is shown to be preformed in a bent configuration. Support rod 21 is attached to backbone 18 in an orientation so that the preformed bend in support rod 21 tends to compensate for the tendency of backbone 18 to bend in response to a transverse load. For example, as shown in FIG. 3, an upper paper guide 31 with pinch rollers 32 is attached to backbone 18. Backbone 18 supports the force applied so that upper paper guide 31 pinches down on media. This pinching force tends to bend the middle of backbone 18 up. Support rod 21 is attached therefore in a configuration that tends to bend the middle of backbone 18 down. The force placed on backbone 18 by the bend in support rod 21 will tend to bend the middle of backbone 18 down, thus compensating for the traverse load of upper paper guide 31 that tends to bend up the middle of backbone 18.

Figure 4:
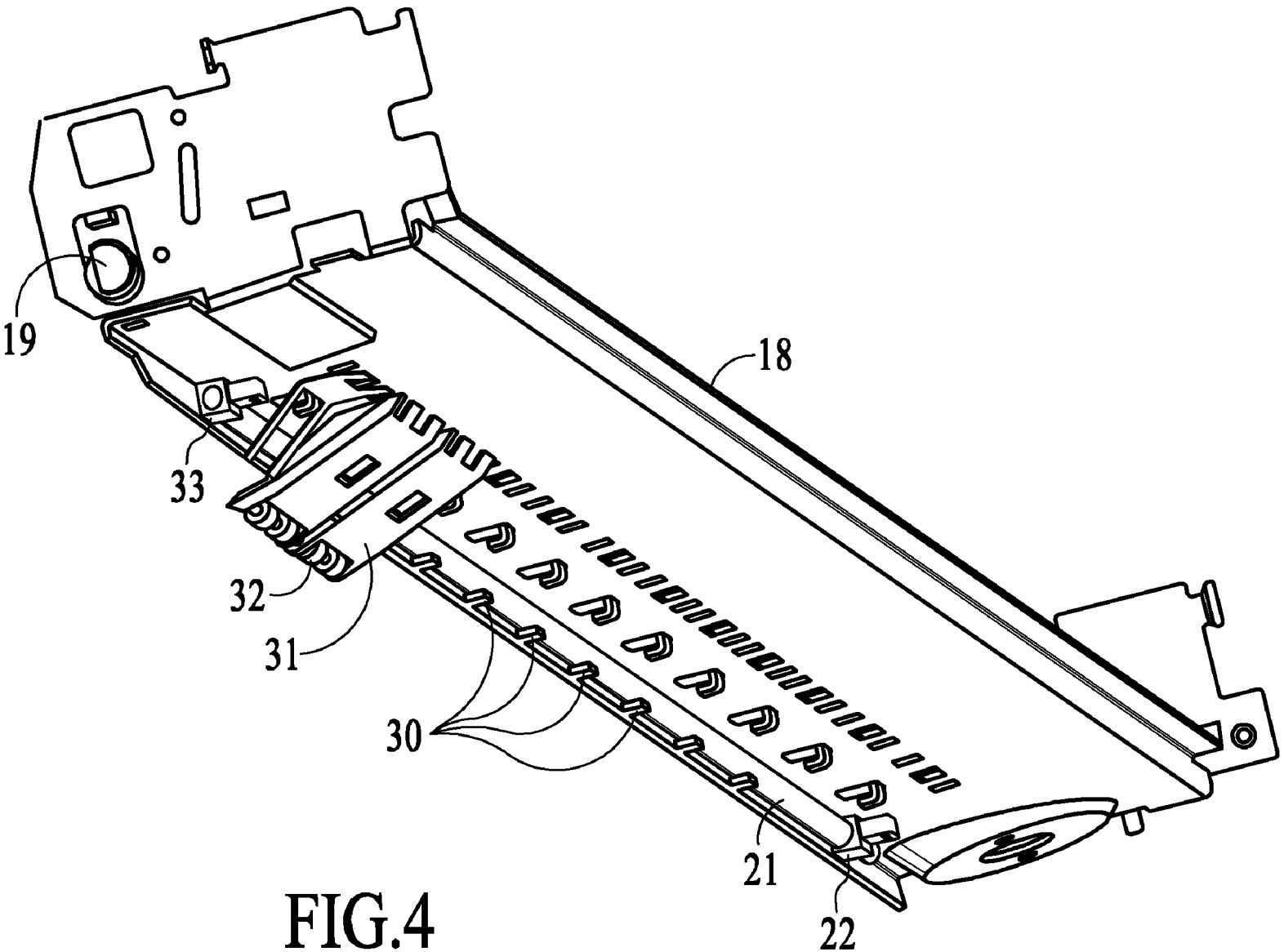
FIG. 4 is a right rear view of a portion of the backbone shown in FIG. 1, revealing additional details of the connection of the support rod to the backbone in accordance with an embodiment of the present invention.

In FIG. 4, rod support hooks 30 are shown securing support rod 21 against backbone 18. Rod support hooks 30 will hold backbone 18 securely to support rod 21 with the result that the backbone 18 and support rod 21 conform to the same shape. Rod support hooks can be an integral part of backbone 18, or can be manufactured separately.

Support rod 21 tends to force the middle of backbone 18 downward to compensate for the tendency of the middle of backbone 18 to bend upward as a result of the transverse load from upper paper guide 31 with pinch rollers 32 pinching down on media. Support rod 21 thus preloads backbone 18 to counteract the load transmitted by the pinch rollers.

Support rod 21 is attached to backbone 18 using rod anchor 33 and rod anchor 22, in addition to or instead of being attached using rod support hooks 30. Rod anchor 22 and rod anchor 33 can be formed as an integral part of backbone 18 or can be manufactured as separate items that are attached to backbone 18.

Figure 5:
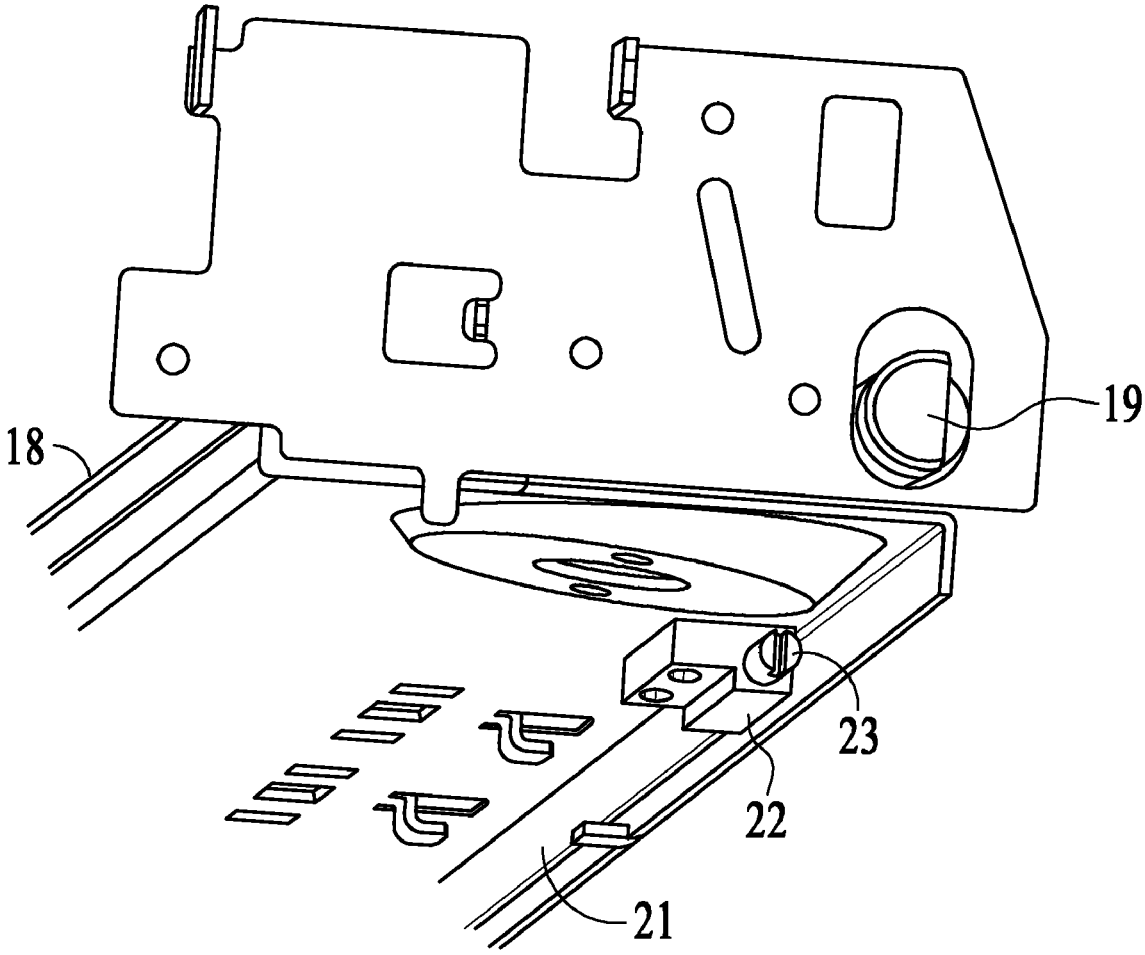
FIG. 5 is a left rear view of a portion of the backbone shown in FIG. 1, revealing additional details of a threaded anchor used to connect the bent support rod to the backbone in accordance with an embodiment of the present invention.

For example, rod anchor 22 is threaded. Threaded pin 23, shown in FIG. 5, allows the tension of support rod between rod anchor 33 and rod anchor 22 to be adjusted to fine tune the amount of compensation provided by support rod 21. Threaded pin 23 can be tightened or loosened to change the bending moment through support rod 21. This allows the effect of support rod 21 to be varied to precisely compensate for the transverse load placed on backbone 18, resulting in optimal performance of printer 10.

Figure 6:
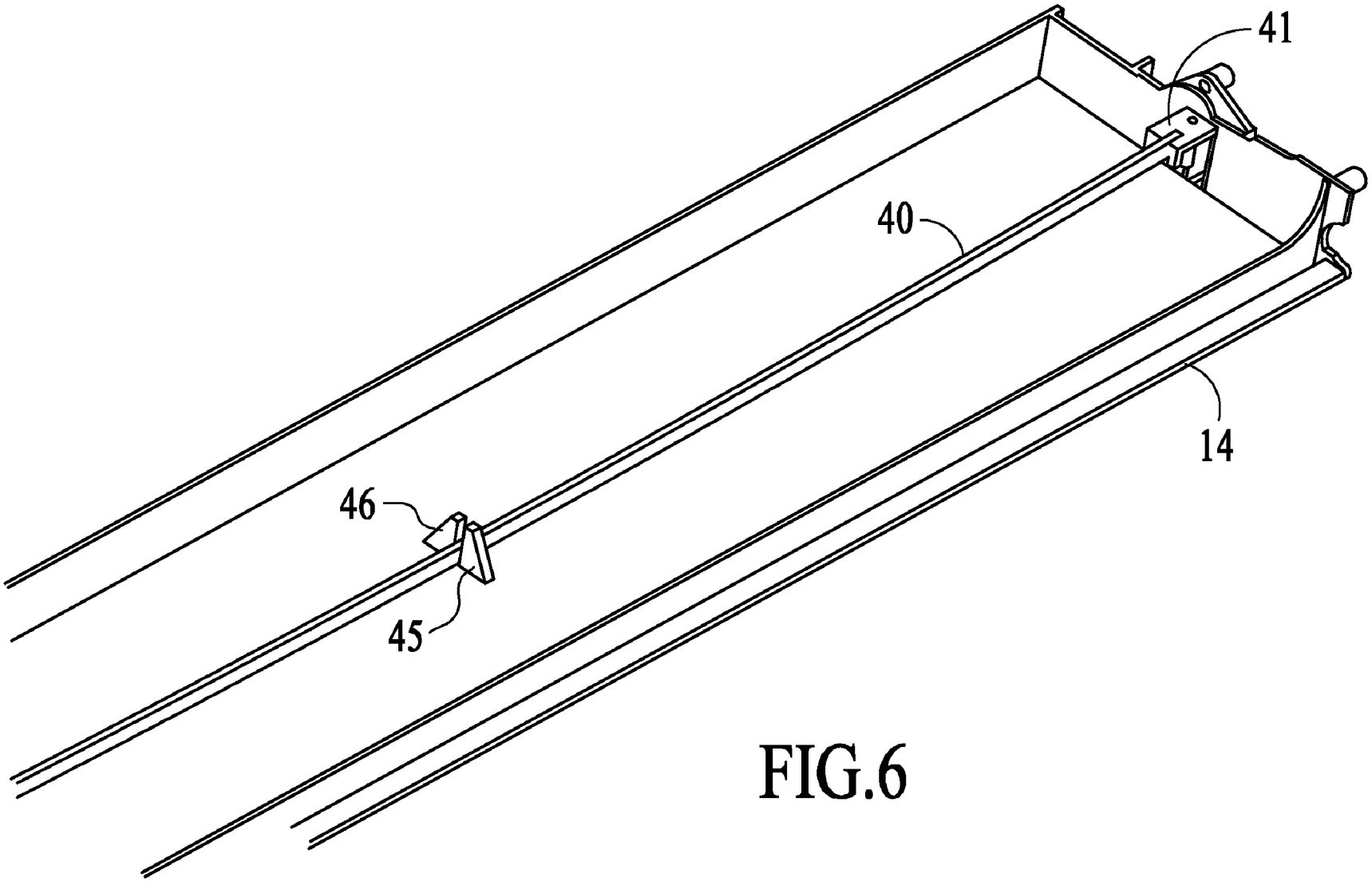
FIG. 6 is a rear underside view of a portion of the platen shown in FIG. 1, illustrating connection of a bent support rod to the platen in accordance with an embodiment of the present invention.

FIG. 6 is a rear underside view of platen 14. In FIG. 6, a first end of support rod 40 is shown to be attached to platen 14 by a rod anchor 41. FIG. 4 shows a second end of support rod 40 being attached to platen 14 by a rod anchor 42. Rod anchor 41 and rod anchor 42 can be formed as an integral part of platen 14, or can be separately manufactured parts attached to platen 14.

In FIG. 6, support rod 40 is shown to be preformed in a bent configuration. The result is that the center of support rod 40 is bowed in toward platen 14. This allows support rod 40 to compensate for the tendency of platen 14 to deform in response to a transverse load. This happens, for example, when an upper paper guide springs creates a load that transfers force to paper guides to pinch rollers to feedshaft 29 to a feedshaft support, either separate from or integrated with platen 14, resulting in a transverse load on platen 14. Support rod 40 is attached therefore in a configuration that tends to bend the middle of platen 14 back up, counteracting the tendency to bend in response to a transverse load.

Figure 7:
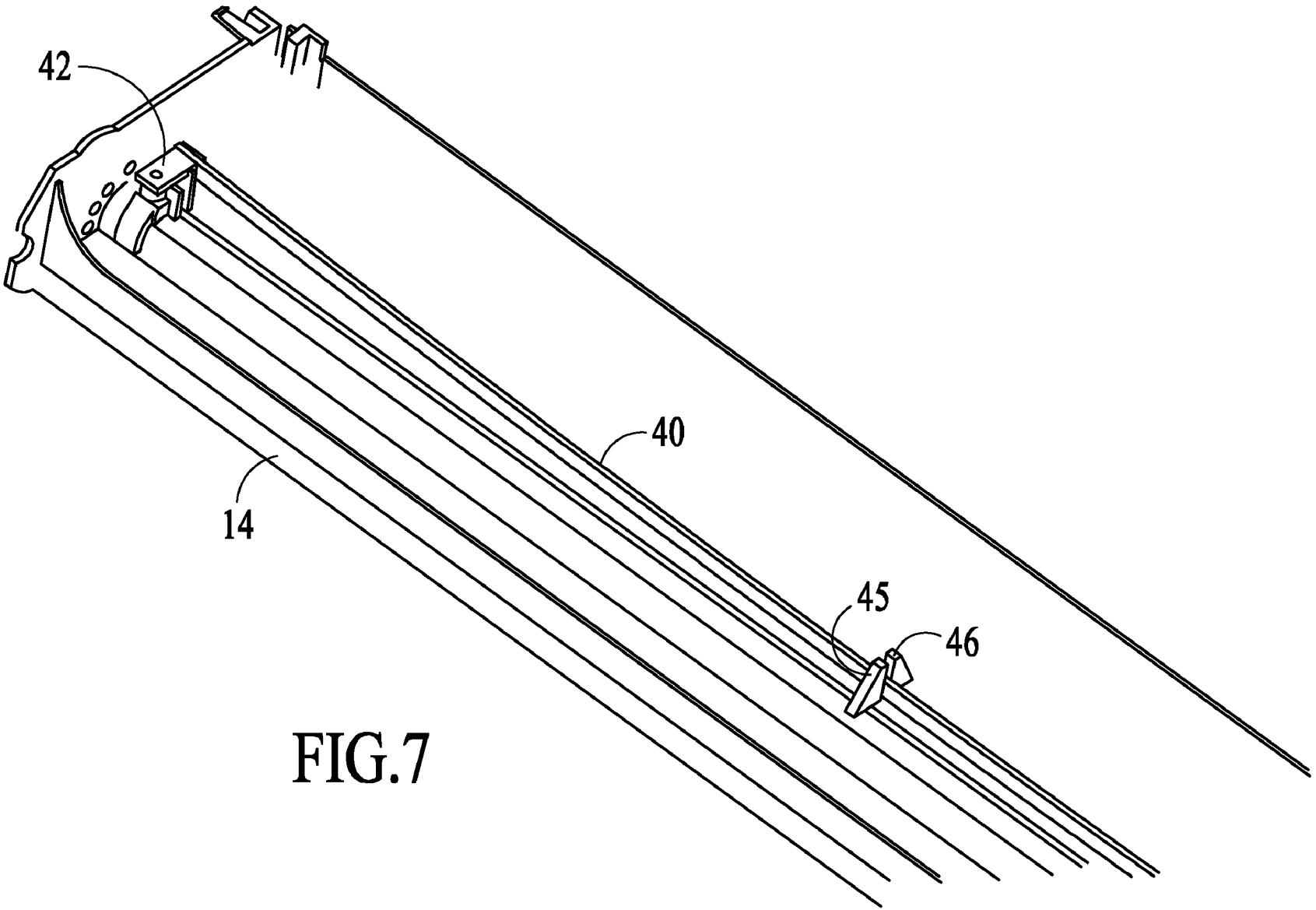
FIG. 7 is another rear underside view of a portion of the platen shown in FIG. 1, illustrating connection of a support rod to the platen in accordance with an embodiment of the present invention.
Figure 8:
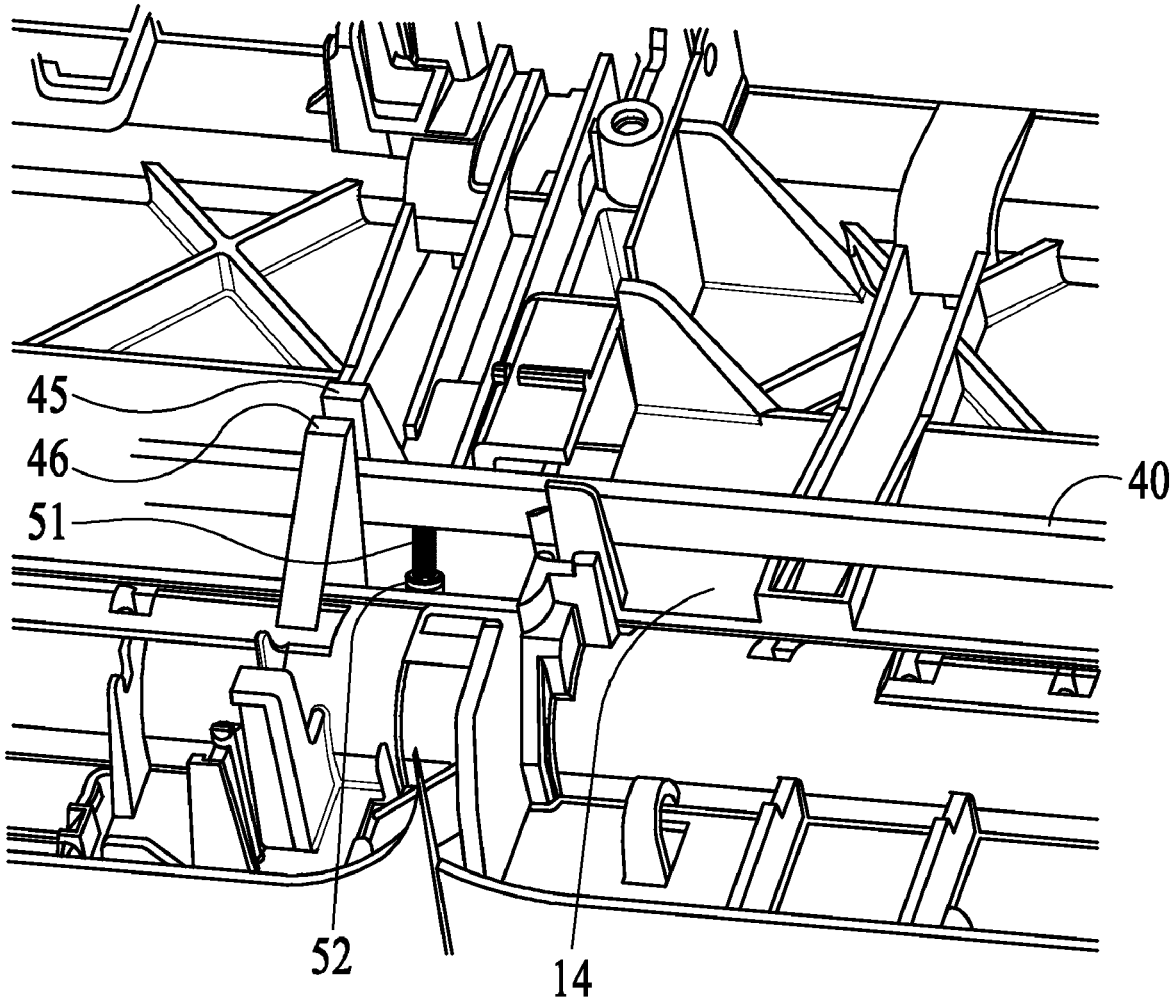
FIG. 8 shows an adjustment mechanism used to adjust displacement provided by the bent support rod in accordance with an embodiment of the present invention.

In addition to, or instead of, using a bend in support rod 40 to counteract the tendency of platen 14 to bend in response to a transverse load, an adjuster can be used to adjust an amount of force support rod 40 exerts against platen 14. For example, FIG. 7 and FIG. 8 show use of an adjustment screw 51 and an adjustment nut 52 to adjust an amount of force the platen support rod exerts against the platen 14. Adjustment screw 51 and adjustment nut 52 vary the amount of compensation provided by support rod 40. Adjustment screw 51 can be tightened or loosened to change the reacting force created by support rod 40. This allows the effect of support rod 40 to be varied to precisely compensate for the transverse load placed on platen 14 so as to maintain a consistent pen-to-media spacing throughout the media width, resulting in optimal performance of printer 10. Instead of adjustment screw 51 and adjustment screw 52, another adjuster, such as a cam, can be used so long as the adjuster allows the amount of force the platen support rod exerts against the platen 14 to be adjusted.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

We claim:

1. A printer comprising:

a backbone on which is mounted a carriage rod;

a carriage assembly mounted on the carriage rod and that slides across the carriage rod;

a support rod, the support rod used to preload the backbone in a direction opposite of an expected transverse load upon the backbone, the preloading supplied by the support rod counteracting a bending force on the backbone resulting from the expected transverse loading; and, an adjuster that adjusts support rod tension to vary amount of preloading.

2. A printer as in claim 1 wherein the support rod is bowed and connected to the backbone using rod support hooks to place the support rod in an orientation that preloads the backbone in the direction opposite the expected transverse load upon the backbone.

3. A printer as in claim 1 additionally comprising:

a first anchor that anchors a first end of the support rod to the backbone; and, a second anchor that anchors a second end of the support rod to the backbone;

wherein the adjuster changes an amount the rod is compressed or tensioned between the first anchor and the second anchor in order to vary an amount of preloading supplied by the support rod.

4. A printer as in claim 3 wherein the first anchor and the second anchor are integrated as part of the backbone.

5. A printer as in claim 1 additionally comprising:

a paper guide attached to the backbone, the paper guide pinching down on media as the media is fed through the printer, the pinching down of the paper guide being a source of at least part of the transverse load upon the backbone.

6. A printer as in claim 1 additionally comprising:

a platen; and, a platen support rod, the platen support rod used to preload the platen in a direction opposite of an expected transverse load upon the platen, the preloading supplied by the platen support rod counteracting a bending force on the platen resulting from the expected transverse loading.

7. A printer as in claim 6 additionally comprising:

a first rod anchor that anchors a first end of the platen support rod to the platen; and a second rod anchor that anchors a first second end of the platen support rod to the platen anchor;

wherein the adjuster adjusts an amount of force the platen support rod exerts against the platen.

8. A printer as in claim 7 wherein the first anchor and the second anchor are integrated as part of the platen.

9. A method comprising:

providing a support surface within a printer;

mounting a support rod to maintain straightness of the support surface, the support rod used to preload the support surface in a direction opposite of an expected transverse load upon the support surface; and, adjusting an amount of preloading supplied by the support rod so that the amount of preloading will counteract a bending force on the support surface resulting from the expected transverse loading.

10. A method as in claim 9 wherein the support surface is a backbone on which is mounted a carriage rod.

11. A method as in claim 9 wherein mounting the support rod includes:

anchoring a first end of the rod to the support surface;

anchoring a second end of the support rod to the support surface; and, using an adjuster to change an amount the support rod is tensioned or compressed between the first anchor and the second anchor to vary the preloading supplied by the support rod.

12. A method as in claim 9 wherein the support surface is a platen.

13. A method as in claim 9 wherein mounting a support rod to increase straightness of the support surface, includes attaching the support rod to the support rod in an orientation such that a bend in the support rod preloads the support surface in the direction opposite of the expected transverse load.

14. A method as in claim 13 additionally comprising:

using a plurality of rod guides to assist in positioning the support rod in relationship to the support surface in an orientation such that the bend in the support rod preloads the support surface in the direction opposite of the expected transverse load.

15. A support surface assembly for a printer, the support surface assembly comprising:

a support surface; and, a support rod, each end of the support rod being fixed to the support surface, the support rod being bowed so as to preload the support surface in a direction opposite an expected transverse load upon the support surface, the preloading supplied by the support rod counteracting a bending force on the support surface resulting from the expected transverse loading.

16. A support surface assembly as in claim 15 wherein the support surface is part of a carriage assembly for the printer.

17. A support surface assembly as in claim 16 additionally comprising:

an adjuster that varies the preloading supplied by the support rod.

18. A support surface assembly as in claim 15 wherein the support surface is one of:

a printer backbone on which is mounted a carriage rod; and, a platen.

19. A support surface assembly as in claim 15 additionally comprising:

a first anchor anchoring a first end of the support rod to the support surface;

a second anchor anchoring a second end of the support rod to the support surface; and, an adjuster used to change an amount the support rod is tensioned or compressed between the first anchor and the second anchor in order to vary the preloading supplied by the support rod.

20. A support surface assembly as in claim 15 additionally comprising:

a first anchor that anchors a first end of the support rod to the support surface;

a second anchor that anchors a second end of the support rod to the support surface; and, an adjuster that adjusts the amount of force the support rod exerts against the support surface.

* * * * *